US005978642A

United States Patent [19]

Arcaro et al.

[11] Patent Number: 5,978,642

[45] Date of Patent: Nov. 2, 1999

[54] COLOR PRINTER WITH SHUTTLE TYPE PAPER DRIVE AND METHOD

[75] Inventors: David J. Arcaro; James G. Bearss, both of Boise, Id.

[73] Assignee: Hewlett-Packard Company, Palo Alto, Calif.

[21] Appl. No.: 09/238,969

[22] Filed: Jan. 27, 1999

[51] Int. Cl.[6] ..... G03G 15/00

[52] U.S. Cl. ..... 399/381; 399/388; 399/394

[58] Field of Search ..... 399/381, 124, 399/167, 388, 394, 397, 401; 271/3.01, 14, 42; 347/262, 264

[56] References Cited

U.S. PATENT DOCUMENTS

| | | | |
|---|---|---|---|
| 4,384,298 | 5/1983 | LaBarre et al. | 346/129 |
| 4,598,298 | 7/1986 | Groenke et al. | 346/134 |
| 5,212,532 | 5/1993 | Storlie | 399/167 |
| 5,462,373 | 10/1995 | Chia | 400/624 |
| 5,727,890 | 3/1998 | Stodder et al. | 400/624 |
| 5,790,915 | 8/1998 | Arcaro et al. | 399/2 |

*Primary Examiner*—Matthew S. Smith
*Assistant Examiner*—Hoan Tran

[57] ABSTRACT

A printing system for printing multiple colors on a sheet of print media includes an electrophotographic printer having a photoconductor drum and a transfer roller configured to interact in co-rotation with the drum during transfer of a color image plane from the drum onto a sheet of print media passed therebetween. A paper drive sheet feeder system is included which has a grit shaft extending generally transverse of a paper travel path, a first pinch roller configured to interact in co-rotation with the grit shaft along a first edge of a sheet of print media, and a second pinch roller configured to interact in co-rotation with the grit shaft along a second edge of the sheet of print media. The grit shaft is driven in rotation to drive the sheet of print media along a bidirectional sheet travel path such that a plurality of different colored image planes is superposed onto the sheet of print media in accurate registration therebetween. A method for printing multiple colors is also described.

20 Claims, 4 Drawing Sheets

COLOR PRINTER WITH SHUTTLE TYPE PAPER DRIVE AND METHOD

FIELD OF THE INVENTION

This invention relates to color printing, and more particularly, to color laser printing systems. This invention also relates to plane registration for color printing systems.

BACKGROUND OF THE INVENTION

Color image printing systems are known in the art. One color image printing system comprises an inkjet printer. An inkjet printer prints color images incrementally, with a continuous inkjet printing process, piezoelectric inkjet printing process or bubble-jet printing process. However, these inkjet printing processes provide relatively low-cost printing that is often satisfactory for printing color graphics images, but is not necessarily of high enough quality for certain business applications.

Another color image printing system comprises a color laser, or electrophotographic, printer. Color laser printers generate sufficient text and graphics quality for most business applications. However, color laser printers typically require complex and expensive mechanisms when forming and aligning overlaid color frames. Hence, color laser printers are not sufficiently economical for many applications.

One problem encountered with color laser printers relates to registration of individual color image planes that generate a printed color page. Typically, three or four distinct color image planes are somehow imaged and transferred onto a common piece of paper in order to generate a color image. In some cases, a yellow, a magenta and a cyan color image plane are each imaged and transferred onto a common piece of paper. In other cases, a black, a yellow, a magenta and a cyan color image plane are each imaged and transferred. Irrespective of whether individual color image planes are serially or concurrently transferred onto a piece of paper, registration of individual color image planes is very important.

One type of color image printing system builds up four different colored image planes onto a well-controlled substrate before transferring the generated image onto a piece of paper. One exemplary printing system comprises a Hewlett-Packard Color LaserJet 5, manufactured by Hewlett-Packard Co. of Palo Alto, Calif. Such exemplary printing system builds up a color image onto a paper size photoconductor drum. The generated image comprises four distinct colors: yellow, magenta, cyan and black. Four developers are used to produce the four colors, with four distinct photoconductor drum rotations being needed to accumulate the four-color toner images.

Another exemplary printing system comprises a Tektronix Phaser 560, manufactured by Tektronix of Wilsonville, Oreg. Such exemplary printing system builds up a color image onto an intermediate transfer medium. However, the use of an intermediate transfer medium adds an additional processing step, which increases cost and complexity. Yet another type of color image printing system comprises a Xerox C55 color laser printer. Such laser printer fixes a sheet of paper onto a drum in order to achieve plane-to-plane registration of successively colored image planes.

Each of the above-mentioned printing systems increases the size of the printer or increases the complexity or cost of the printer. Therefore, there exists a need to provide a reduced cost and complexity technique for achieving a multiple pass color laser printer that realizes improved plane-to-plane registration usable with a wide range of media types.

SUMMARY OF THE INVENTION

A shuttle type paper drive provides a relatively low cost technique for achieving a multiple pass color laser printer having excellent plane-to-plane registration and usable with a wide range of media types. According to one implementation, a four pass color laser printer achieves improved registration for most types of printable paper.

According to one aspect, a printing system for printing multiple colors on a sheet of print media includes an electrophotographic printer having a photoconductor drum and a transfer roller configured to interact in co-rotation with the drum during transfer of a color image plane from the drum onto a sheet of print media passed therebetween. A paper drive sheet feeder system is included which has a grit shaft extending generally transverse of a paper travel path, a first pinch roller configured to interact in co-rotation with the grit shaft along a first edge of a sheet of print media, and a second pinch roller configured to interact in co-rotation with the grit shaft along a second edge of the sheet of print media. The grit shaft is driven in rotation to drive the sheet of print media along a bidirectional sheet travel path such that a plurality of different colored image planes is superposed onto the sheet of print media in accurate registration therebetween.

According to another aspect, a paper drive sheet feeder system is provided which includes a grit shaft, a first pinch roller and a second pinch roller. The grit shaft extends substantially transverse of a paper travel direction and is supported to be driven in bidirectional rotation. The first pinch roller is supported for co-rotation via biased engagement therebetween such that a first edge of a sheet of print media is engaged and moved therebetween. The second pinch roller is supported for co-rotation via biased engagement therebetween such that a first edge of a sheet of print media is engaged and moved therebetween. The grit shaft is driven in rotation in forward and reverse directions so as to form a bidirectional sheet advancement system which carries a sheet of print media in accurate forward and reverse engagement between the grit shaft and the pair of pinch rollers therebetween.

According to yet another aspect, a method of printing on a sheet of print media is provided. The method includes the steps of: transferring a sheet of print media between a grit shaft and a pair of pressure rollers; developing a first color image plane on a photoconductor drum; transferring the first color image plane onto the sheet of print media by moving the sheet of print media between the grit shaft and the pair of pressure rollers such that the sheet of print media passes between the photoconductor drum and the transfer roller along a paper travel path; developing a successive color image plane on the photoconductor drum; transferring successive color image planes onto the sheet of print media by moving the sheet of print media with the grit shaft and the pressure rollers between the photoconductor drum and the transfer roller along the paper travel path; and fusing all transferred color image planes onto the sheet of print media by passing the sheet of print media through a fuser.

One advantage is provided by precisely transferring a sheet of print media between successive passes against a photoconductor drum while transferring successive color image planes onto the sheet of print media so as to ensure precise registration between successive color image planes.

DESCRIPTION OF THE DRAWINGS

Preferred embodiments of the invention are described below with reference to the following accompanying drawings depicting examples embodying the best mode for practicing the invention.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

Figure 1:
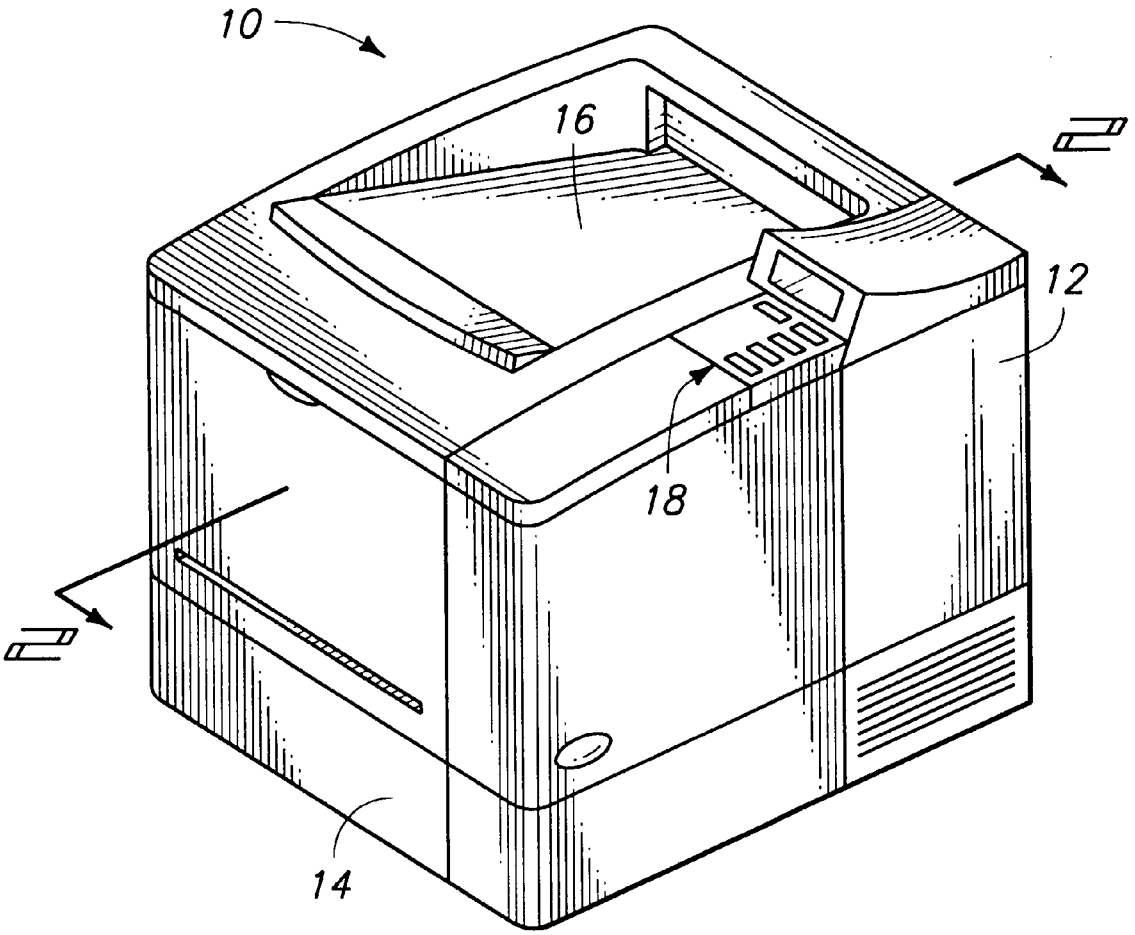
FIG. 1 is a perspective view of a printing system in accordance with one embodiment of Applicant's invention.

FIG. 1 shows a printing system 10 embodying Applicant's invention usable for printing color images onto a sheet or page of print media. Typically, printing system 10 is connected for control with a microprocessor-based computer (not shown). Printing system 10 comprises an electrophotographic printer configured to print monochrome and/or color images onto a sheet. As shown in FIG. 1, color laser printer 10 includes a housing 12, a paper tray 14, an output tray 16 and a user interface 18. User interface 18 includes one or more of a keyboard, display or keypad that enables a user to operate and/or configure printer 10.

As shown in FIG. 1, color laser printer 10 is configured to generate four different colored image planes. Alternatively, printer 10 can be configured to compose at least three different colored image planes. Irrespective of the total number of image planes, the ability to align such planes to one another is critical to achieving precise color printing.

Figure 2:
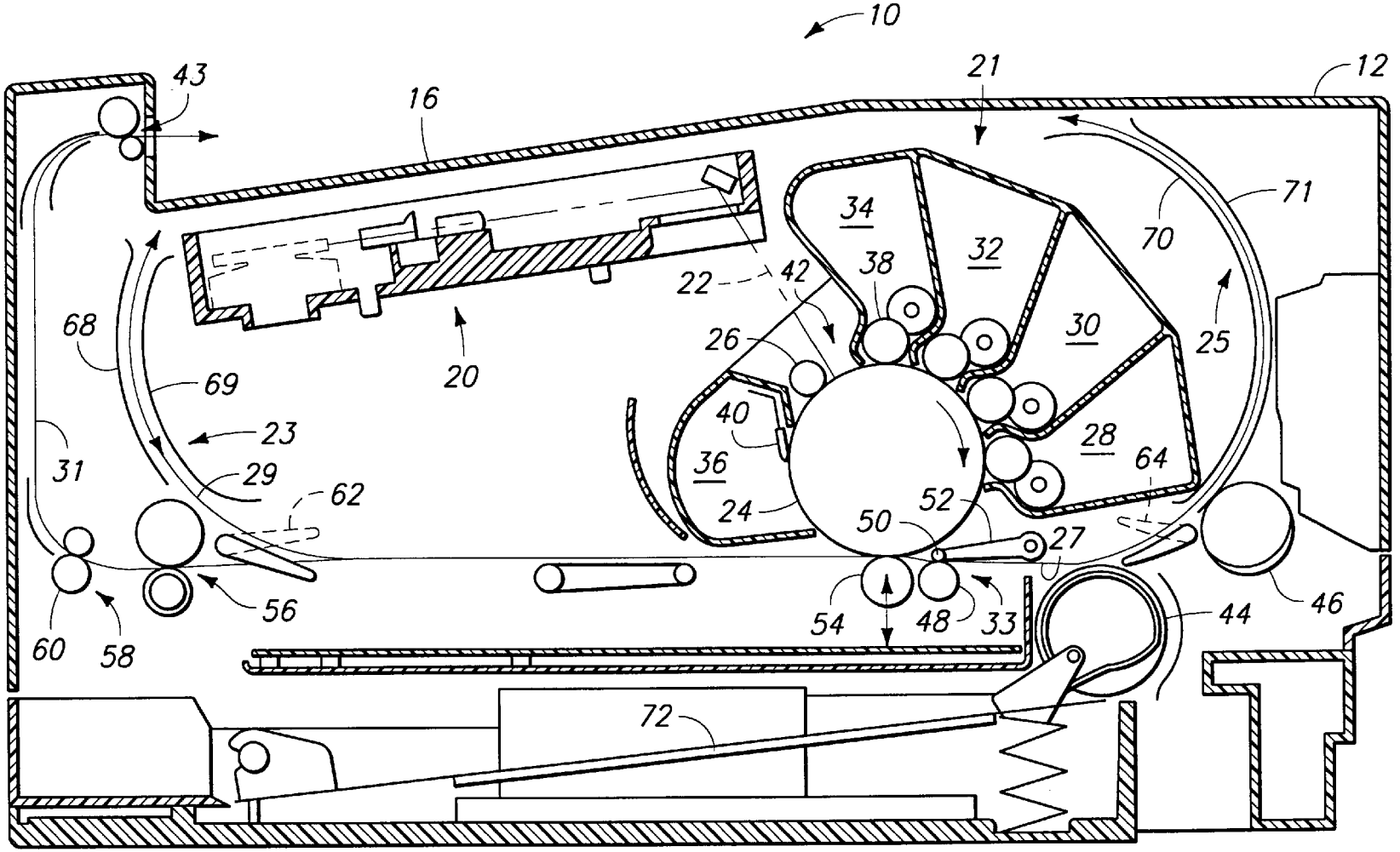
FIG. 2 is a vertical sectional view of the printing system of FIG. 1 taken along line 2—2.

FIG. 2 illustrates shuttle type paper drive color laser printer 10 in vertical sectional view to enable description of internal operating components. As shown in FIG. 2, a paper shuttle path 29 is depicted within printer 10, extending between a forward guide track 23 and a reverse guide track 25. In operation, individual sheets of paper are retrieved from paper tray 14 via a pick roller 44 such that a single sheet of paper is deposited at the nip between a pair of spring-biased pressure rollers 50 and a single elongate grit-covered transfer roller 54. Grit shaft 48 is rotatably actuated so as to deliver a single sheet of paper 27 into position between a photoconductor drum (or roller) 24 and a transfer roller 54 such that a first color image plane can be printed onto the sheet of paper 27 from drum 24. Accordingly, such sheet of paper 27 is presented between rollers 50 and shaft 48 and is passed against photoconductor drum 24 so as to deliver a first image onto sheet of paper 27, with paper 27 being further delivered along forward guide track 23. After transfer of the first image plane onto sheet of paper 27, transfer roller 54 is downwardly biased away from photoconductor drum 24 while rollers 50 and shaft 48 are used to move sheet of paper 27 into reverse guide track 25. Subsequently, additional color planes are deposited onto drum 24, then transferred onto sheet of paper 27 via the above technique. Shaft 48 and rollers 50 cooperate to provide a paper drive sheet feeder system.

More particularly, FIG. 2 illustrates the workings of an electrophotographic printer 10. A laser scanner 20 is provided therein for generating an optical image via an imaging path or a slot 22 which is superposed onto photoconductor drum 24 after drum 24 has been charged with a charge roller 26. Subsequently, one of four different colored toners is delivered from one of toner supply reservoirs 28, 30, 32 and 34.

Printing system 10 is preferably connected for control with a microprocessor-based computer (not shown) which submits print jobs to such printing system 10. Printing system 10 includes an electrophotographic printer that is configured to print a color image onto sheet 27, in the form of an image plane (e.g., including text and/or graphics). As used here, the term "image" is intended to mean text, graphics, or both text and graphics.

As shown in FIG. 2, printing system 10 comprises a color laser printer. In one embodiment, printer 10 includes internal components similar to those found in a LaserJet 5000 printer sold by Hewlett-Packard Company of Palo Alto, Calif.

Printing system 10 includes a housing 12 configured to support internal operating components. In the illustrated embodiment, printer 10 includes laser scanner 20 supported in housing 12, a toner supply contained within one of toner supply reservoirs 28–34, photoconductor drum 24 which is acted upon by laser scanner 20, charge roller 26 which imparts charges to photoconductor drum 24 upstream of where laser scanner 20 acts on the photoconductor drum 24, a developer roller 38 provided in each of reservoirs 28–34 which acts on the photoconductor drum 24 downstream from where the laser scanner 20 acts on photoconductor drum 24, a transfer roller 54 facing the photoconductor drum 24 downstream from the developer roller 38 and cooperating with the photoconductor drum 24 to impart an image onto sheet 27, a cleaning blade 40 configured to clean photoconductor drum 24 within a waste toner reservoir 36 after the image has been imparted to sheet 27, and a fuser 56 spaced apart from and downstream of the photoconductor drum 24.

According to the implementation depicted in FIG. 2, a single toner cartridge 21 is employed to contain "black" toner sensor reservoir 28, "cyan" toner sensor reservoir 30, "magenta" toner sensor reservoir 32, and "yellow" toner sensor reservoir 34. Hence, each of reservoirs 28–34 contains a powder toner having a respective associated color. Additionally, a waste toner reservoir 36 is also provided in cartridge 21 for collecting waste toner that is removed by cleaner blade 40 from photoconductor drum 24, after depositing an image plane onto sheet of paper 27. Toner cartridge 21 further includes an aperture, or slot, 42 in which charge roller 26 is supported in contact with drum 24, and through which optical images are delivered via imaging path 22 onto charged photoconductor drum 24.

Preferably, toner cartridge 21 is designed as a replaceable toner/developer cartridge, with color being accomplished by using multiple development stations as provided by reservoirs 28–34. One color is associated with each reservoir 28–34 for the subtractive colors cyan, yellow and magenta, plus black. Typically, toners are colored with either a dye or a pigment. In operation, the four colored image planes are accumulated one at a time onto photoconductor drum 24, then transferred onto sheet of paper 27. In this manner, sheet of paper 27 is passed between application roller 24 and transfer roller 54 up to four separate times.

It is understood that printing system 10 works as any presently understood electrophotographic, or laser, printing process. More particularly, charge roller 26 comprises a conductive elastomer charge roll that is placed in direct contact with photoconductor drum 24. Charge roller 26 generates a charge on the surface of photoconductor drum 24. Subsequently, laser scanner 20 exposes the charged photoconductor drum 24 via imaging path 22 with a wavelength of exposing light source that matches the spectra sensitivity of photoconductor drum 24. The developed photoconductor drum 24 imparts monocomponent image development by receiving powder toner onto the charged surface of photoconductor drum 24, after which such toner is delivered onto paper 27 when such paper 27 is passed between transfer roller 54 and photoconductor drum 24. Accordingly, monocomponent development is well understood in the art, and is carried out up to four different times in order to deliver up to four different color planes onto a single sheet of paper 27.

The novelty of Applicant's invention lies in the manner in which a single sheet of paper 27 is repeatedly delivered in an accurate positional manner across photoconductor drum 24 when delivering up to four superposed image planes thereon.

Accordingly, the provision of forward guide track 23 and reverse guide track 25 enables the transport of paper 27 during the four electrophotographic print operations used to deliver four superposed color image planes onto paper 27. In order to achieve precise registration between success of color planes, grit shaft 48 cooperates with spring-biased rollers 50, to maintain continuous engagement with sheet 27 along opposed parallel edges while such sheet 27 is delivered between tracks 23 and 25, and between transfer roller 54 and photoconductor drum 24.

It is understood that a color print is composed of at least three, and usually four, different colored image planes. The precise alignment of these image planes to one another is critical to achieving a high-quality color image being placed onto a sheet of paper. Even slight variations in placement between successive image planes can cause hue and density shifts throughout the printed page.

Pursuant to the implementation depicted in FIG. 2, four color image planes are successively imaged and transferred directly onto sheet of paper 27 in essentially the same manner as a readily understood prior art monochrome laser printer. However, a shuttle type paper drive 33 is provided in printer 10 consisting of grit shaft 48 and a pair of edge pressure, or pinch, rollers 50 which clamp paper 27 at its left and right margins so as to impart precise registration and delivery of such paper therebetween. It is understood that paper, or media, having different widths can be accommodated either by moving one of rollers 50 laterally so as to correspond with paper tray guides of different widths, or having a plurality of available clamp locations, with one of such clamp locations being activated for a specific paper tray guide position. Because paper 27 remains clamped to the grit shaft throughout the development and transfer of all four color image planes, excellent color plane registration is achieved onto sheet of paper 27.

In order to achieve a shuttle type paper drive mechanism within printer 10, a pair of paper redirection guides 62 and 64 are carried within housing 12, where guide 62 is activated via a solenoid and guide 64 is spring-biased and activated by paper advancement at desired times so as to impart redirection of paper 27 while being transferred therein. For example, during a first pass deposition of a first color image plane onto paper 27, such paper 27 is transferred into forward guide track 23 by downwardly biasing paper redirection guide 62 such that paper 27 is delivered upwardly into guide track 23, between a pair of track walls 68 and 69 extending on left and right edges of paper 27, and formed on the inside surface of housing 12. Similarly, reverse guide track 23 includes a pair of track walls 70 and 71 formed on the inside surface of housing 12, along the left and right edges of paper 27. Likewise, paper redirection guide 64 is downwardly biased during a reverse paper travel path movement which causes paper 27 to move into reverse guide track 25, via coaction with downwardly biased paper redirection guide 64. Such reverse movement comprises a backwards refeeding operation of paper 27 between deposition of successive print images onto paper 27.

Accordingly, the implementation depicted in FIG. 2 delivers a sheet of paper from within tray 14, off a pressure plate 72 by way of a pick roller 44. Pick roller 44 guides such delivered sheet of paper between rollers 50 and grit shaft 48 such that paper 27 is introduced into the grit shaft 48 and pressure roller 50 nip. An alternative pick roller 46 is provided for delivering paper 27 from another supply of paper via a paper tray (not shown) provided externally of printer 12. When such alternative paper delivery is implemented, paper redirection guide 64 is upwardly biased so as to provide clearance during delivery of such paper into the nip between grit shaft 48 and rollers 50.

Once a sheet of paper has been delivered into the nip between shaft 48 and rollers 50, transfer roller 54 is upwardly engaged into contact with photoconductor drum 24 such that sheet of paper 27 is passed between drum 24 and roller 54, after drum 24 has been charged, an image has been applied and toner has been adhered thereto. Accordingly, full forward delivery of paper 27 during a first pass imparts such toner thereon, with such paper being delivered to forward guide track 23. After depositing the first image, transfer roller 54 is lowered from drum 24, after which grit shaft 48, in combination with rollers 50, is used to drive paper 27 in a reverse direction into reverse guide track 25 until a leading edge of paper 27 is still held between rollers 50 and grit shaft 48. Subsequently, photoconductor drum 24 is recharged, a second color image plane is applied thereon, and a second toner is applied thereto. After which, roller 54 is upwardly biased against drum 24 and paper 27 is delivered in a forward direction via grit shaft 48, rollers 50, to deposit the second color image thereon and registration therewith and delivery of such paper 27 into the forward guide 23. Such operation is carried out two more times in order to deliver the remaining two color image planes onto paper 27.

However, prior to application of the last color image plane onto paper 27, paper redirection guide 62 is actuated to an upwardly biased position such that paper 27 is delivered into a fuser 56, comprising a pair of heated rollers that fuse the resulting colored image onto paper 27. Fuser 56 delivers such paper to a pair of advancement rollers, and finally to a pair of exit rollers 43 where the printed and fused paper 27 is ejected into output tray 16 for retrieval by a user who has submitted a print job thereto.

As shown in FIG. 2, pick rollers 44 and 46 comprise any of a number of pick roller constructions that are presently understood in the art. One exemplary pick roller construction is depicted in U.S. Pat. No. 5,462,373 to Chia, herein incorporated by reference, and illustrating construction of a heat advancement system having a roller arrangement with first and second rollers that impart in phase and out of phase rotation for engaging and gripping a sheet of paper for delivery from a stack while eliminating roller drag as such sheets pass beneath the rollers. However, it is understood that any of a number of pick roller constructions can be utilized to retrieve a sheet of paper from paper tray 12 and delivery to grit shaft 48 and edge rollers 50.

More particularly, it is understood that construction of grit shaft 48 comprises a single elongate shaft having a roughened, machine-etched, ground, or cut outer surface, or grit-covered outer surface. Shaft 48 is driven in rotation to induce movement of a sheet of paper which is engaged along each left and right edge by one of edge rollers 50.

Edge rollers 50 comprise pinch or pressure rollers that are spring-biased into engagement with grit shaft 48 via action of a spring loaded arm 52, on which each edge roller 50 is carried for rotatably biased engagement and co-rotation with shaft 48. Preferably, rollers 50 comprise a semi-resilient material such as a neoprene, nylon or plastic material.

Preferably, grit shaft 48 is driven for bidirectional rotation via a high-resolution stepper motor, and/or includes encoders that will ensure excellent image plane registration between successive image planes.

Figure 3:
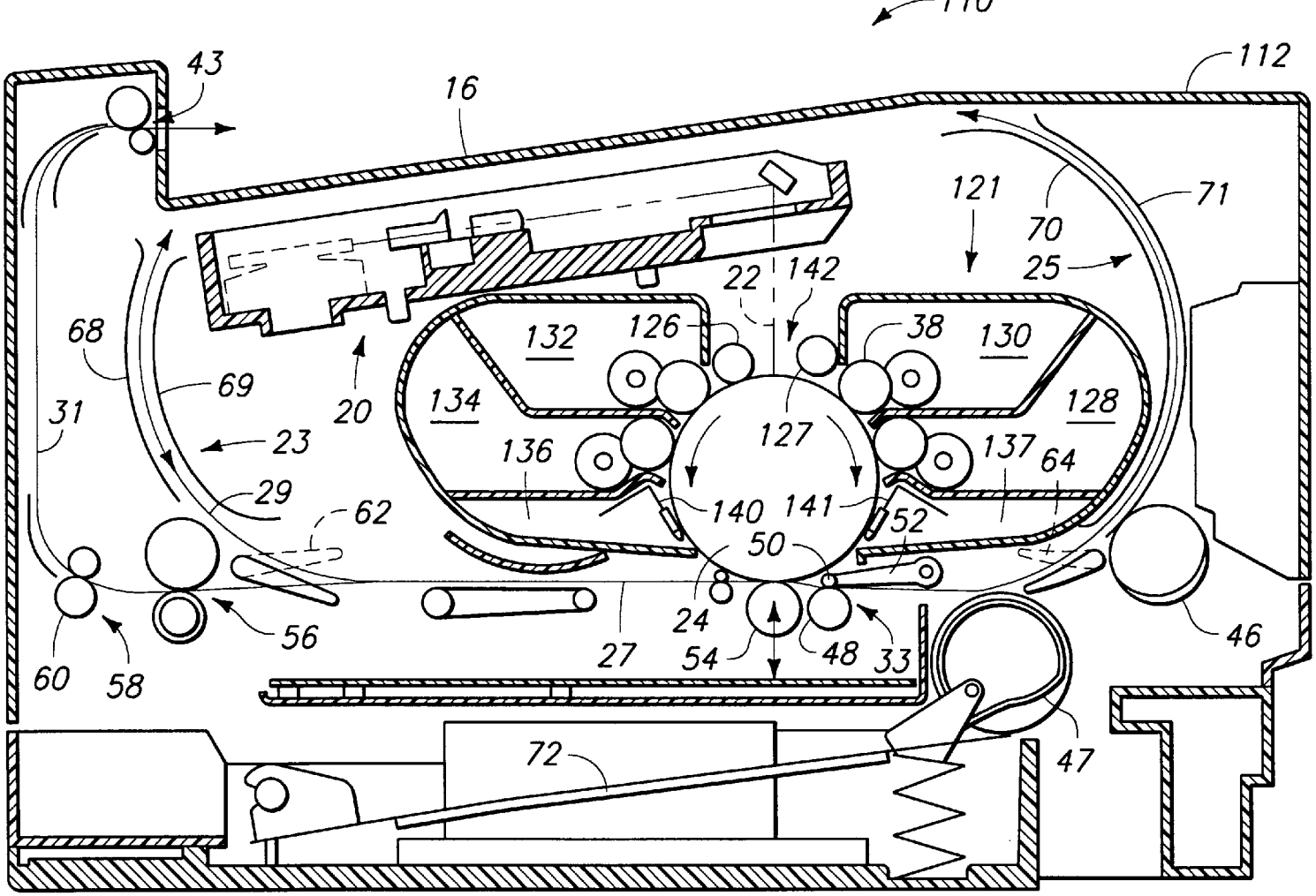
FIG. 3 is a vertical sectional view of an alternative embodiment taken at the same location as FIG. 2.

FIG. 3 illustrates an alternative construction in which printing speed can be increased somewhat by exposing and developing photoconductor drum 24 in both a forward and a reverse direction. Hence, print speed is increased by saving transit time that is required when reversing sheet of paper 27 from forward guide track 23 to reverse guide track 25. However, this construction requires the addition of two charge rollers 126 and 127, and two cleaning blades 140 and 141, along with a means of selectively actuating charge rollers 126 and 127. One of charge rollers 126 and 127 is moved into engagement with drum 24 while the other is moved away, depending upon the direction of rotation of photoconductor drum 24 and the direction of advancement of sheet of paper 27 during a printing operation.

Pursuant to the alternative construction depicted in FIG. 3, housing 112 is essentially identical to housing 12 of FIG. 2. Laser scanner 20, forward guide track 23, reverse guide track 25, paper tray 14, pick rollers 44 and 46, fuser 56 and rollers 60 and 43 are essentially the same as those depicted in FIG. 2. However, toner cartridge 121 is configured differently, having a centrally located aperture 142. Black toner reservoir 128, cyan toner reservoir 130 and a waste toner reservoir 136 are located on one side of aperture 142. Magenta toner reservoir 132, yellow toner reservoir 134 and waste toner reservoir 136 are located on an opposite side of aperture 142. Waste toner reservoirs 136 and 137 each contained the cleaner blade 140 and 141, respectively, for cleaning toner from photoconductor drum 24 that remains thereon following transfer of a print frame onto sheet of paper 27.

Figure 4:
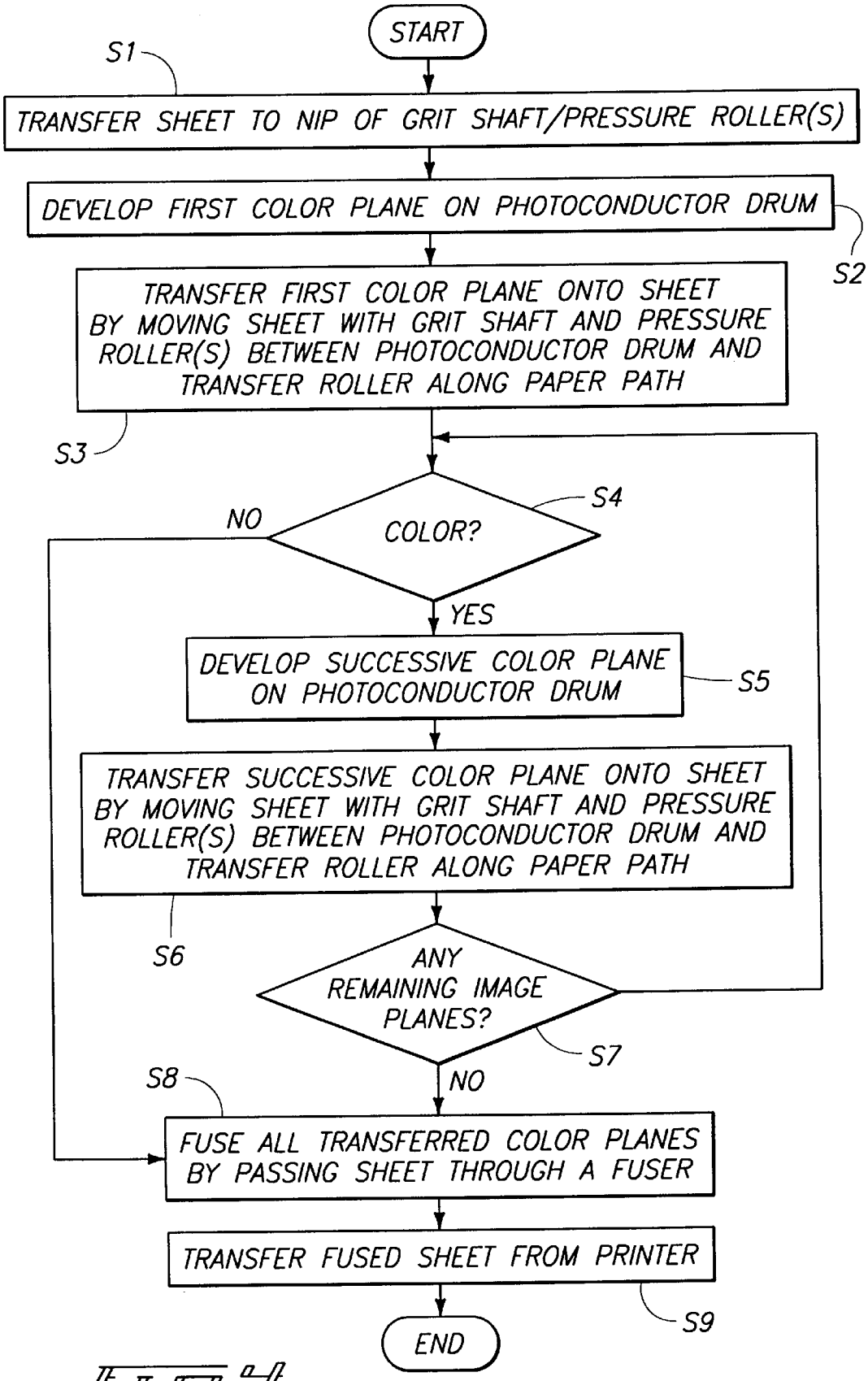
FIG. 4 is a flow chart illustrating logic employed by the paper drive system included in the printing system of FIGS. 1–3.

FIG. 4 is a flow chart illustrating logical operations employed when implementing the shuttle-type paper drive color laser printing features of Applicant's invention. In a Step "S1", the shuttle-type paper drive system transfers a sheet of paper to the nip of the grit shaft and edge pressure rollers. After performing Step "S1", the shuttle-type paper drive proceeds to Step "S2".

In Step "S2", the shuttle-type paper drive system develops a first color plane onto the photoconductor drum. After performing Step "S2", the shuttle-type paper drive system proceeds to Step "S3".

In Step "S3", the shuttle-type paper drive system transfers the first color plane onto the sheet by moving the sheet with the grit shaft and pressure rollers between the photoconductor drum and the transfer roller along a paper travel path. After performing Step "S3", the shuttle-type paper drive system proceeds to Step "S4".

In Step "S4", the shuttle-type paper drive system determines whether the print job request requires color printing; namely, printing of more than one color plane onto the sheet. If so, the process proceeds to Step "S5". If not, the process proceeds to Step "S8".

In Step "S5", the shuttle-type paper drive system develops a successive color plane onto the photoconductor drum. After performing Step "S5", the shuttle-type paper to system proceeds to Step "S6". In Step "S6", the shuttle-type paper drive system transfers the successive color plane onto the sheet by moving the sheet with the grit shaft and edge pressure rollers, between the photoconductor drum and the transfer roller and along the paper travel path. After performing Step "S6", the shuttle-type paper drive system proceeds to Step "S7".

In Step "S7", a determination is made as to whether any remaining image planes need to be transferred onto the sheet of paper. If so, the shuttle-type paper drive system proceeds to Step "S5"; if not, the shuttle-type paper drive system proceeds to Step "S8".

In Step "S8", the shuttle-type paper drive system fuses all transferred color planes onto the sheet of paper by passing the sheet of paper through a fuser. After performing Step "S8", the shuttle-type paper drive system proceeds to Step "S9".

In Step "S9", the shuttle-type paper drive system transfers the fused sheet of paper from within the printer. Following Step "S9", the process for printing a single sheet of paper terminates and the printer proceeds to printing a subsequent sheet of paper, or shuttle off or goes into an idle mode if no existing printing request is remaining.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A printing system for printing multiple colors on a sheet of print media, comprising:

an electrophotographic printer having a photoconductor drum and a transfer roller configured to interact in co-rotation with the drum during transfer of a color image plane from the drum onto a sheet of print media passed therebetween; and a paper drive sheet feeder system having a grit shaft extending generally transverse of a paper travel path, a first pinch roller configured to interact in co-rotation with the grit shaft along a first edge of a sheet of print media, and a second pinch roller configured to interact in co-rotation with the grit shaft along a second edge of the sheet of print media;

wherein the grit shaft is driven in rotation to drive the sheet of print media along a bidirectional sheet travel path such that a plurality of different colored image planes are superposed successively onto the sheet of print media in accurate registration therebetween.

2. The printing system of claim 1 wherein the first and the second pinch rollers are each carried in co-rotating engagement with the grit shaft by a spring-loaded arm.

3. The printing system of claim 1 wherein the transfer roller is carried for engagement and disengagement with the photoconductor drum such that the transfer roller is biased in engagement with the photoconductor drum during transfer of a color image plane from the drum to the sheet of print media, and the transfer roller is biased away from the photoconductor drum during advancement of the sheet of paper along the sheet travel path.

4. The printing system of claim 3 wherein the photoconductor drum and the transfer roller cooperate to deposit a color image plane onto the sheet of print media while the sheet of print media is advanced by the paper drive sheet feeder system in a forward direction, and the transfer roller is biased away from the photoconductor drum while the sheet of print media is moved in a reverse paper travel path direction, prior to depositing a second color image plane thereon.

5. The printing system of claim 1 wherein the grit shaft and the pinch rollers cooperate to form a bidirectional sheet advancement system.

6. The printing system of claim 5 wherein the bidirectional sheet advancement system further comprises a forward guide track and a reverse guide track.

7. The printing system of claim 6 further comprising a paper redirection guide movable to redirect movement of the sheet of print media during a printing operation between a paper guide track and a paper exit path.

8. The printing system of claim 1 wherein the paper travel path comprises a forward guide track and a reverse guide track.

9. The printing system of claim 8 wherein the forward guide track and the reverse guide track each comprises a pair of track walls formed within a housing of the printing system through which the sheet of print media is guided therebetween.

10. A paper drive sheet feeder system, comprising:

a grit shaft extending substantially transverse of a paper travel direction and supported to be driven in bidirectional rotation;

a first pinch roller supported for co-rotation with the grit shaft via biased engagement therebetween such that a first edge of a sheet of print media is engaged and moved therebetween; and a second pinch roller supported for co-rotation with the grit shaft via biased engagement therebetween such that a first edge of a sheet of print media is engaged and moved therebetween;

wherein the grit shaft is driven in rotation in forward and reverse directions so as to form a bidirectional sheet advancement system which carries a sheet of print media in accurate forward and reverse engagement between the grit shaft and the pair of pinch rollers therebetween.

11. The paper drive sheet feeder system of claim 10 wherein the first and second pinch rollers each comprises a compliant roller carried for rotation on a spring-loaded arm, the arm urging the roller towards engagement with the grit shaft for co-rotation therebetween as a sheet of paper is moved therebetween.

12. The paper drive sheet feeder system of claim 10 further comprising an electrophotographic printer having a photoconductor drum and a transfer roller, the grit shaft and pair of pinch rollers cooperating to move the sheet of print media between the photoconductor drum and the transfer roller such that individual colored image planes are transferred from the photoconductor drum onto to the sheet of print media as the sheet of print media is passed between the photoconductor drum and the transfer roller.

13. The paper drive sheet feeder system of claim 12 wherein the transfer roller is movably supported in relation to the photoconductor drum such that the transfer roller is biased for engagement and co-rotation with the photoconductor drum during transfer of a color image plane onto the sheet of print media, and biased away from the photoconductor drum during transfer of the sheet of print media along a paper travel path, prior to transferring a successive color image plane onto the drum and the sheet of print media.

14. A method of printing on a sheet of print media, the method comprising:

transferring a sheet of print media between a grit shaft and a pair of pressure rollers;

developing a first color image plane on a photoconductor drum;

transferring the first color image plane onto the sheet of print media by moving the sheet of print media between the grit shaft and the pair of pressure rollers such that the sheet of print media passes between the photoconductor drum and a transfer roller along a paper travel path;

developing at least one successive color image plane on the photoconductor drum;

transferring successive color image planes onto the sheet of print media by moving the sheet of print media with the grit shaft and the pressure rollers between the photoconductor drum and the transfer roller along the paper travel path; and fusing all transferred color image planes onto the sheet of print media by passing the sheet of print media through a fuser.

15. The method of claim 14 wherein a cyan color plane, a magenta color plane, and a yellow color plane are successively transferred onto the sheet of print media from the photoconductor drum.

16. The method of claim 15 wherein a black color image plane is further transferred from the photoconductor drum onto the sheet of print media.

17. The method of claim 14 wherein each color image plane is transferred onto the sheet of print media as the sheet of print media is moved along the paper travel path toward a forward guide track.

18. The method of claim 14 wherein the steps of transferring the first or the successive color image planes comprise moving the sheet of print media in a forward direction and in contact with the photoconductor drum.

19. The method of claim 18 wherein after transferring the first or successive color image planes onto the sheet of print media, further comprising the steps of retracting the transfer roller away from the photoconductor drum and moving the sheet of print media in a reverse direction prior to depositing a subsequent color image plane onto the photoconductor drum.

20. The method of claim 14 wherein the step of transferring a sheet of print media comprises rotatably driving the grit shaft so as to move the sheet of print media between the grit shaft and the pair of pressure rollers.

* * * * *